United States Patent [19]

Kuroda et al.

[11] Patent Number: 4,770,000

[45] Date of Patent: Sep. 13, 1988

[54] DEFROSTING OF REFRIGERATOR SYSTEM OUT-DOOR HEAT EXCHANGER

[75] Inventors: Sigeaki Kuroda; Kensaku Oguni, both of Shimizu; Hiromu Yasuda; Hirokiyo Terada, both of Shizuoka, all of Japan

[73] Assignee: Hitachi, Ltd., Tokyo, Japan

[21] Appl. No.: 66,301

[22] Filed: Jun. 25, 1987

[30] Foreign Application Priority Data

Jun. 25, 1986 [JP] Japan ..... 61-147073

[51] Int. Cl.[4] ..... F25D 21/06

[52] U.S. Cl. ..... 62/156; 62/196.3; 62/196.4; 62/278

[58] Field of Search ..... 62/196.1, 196.3, 196.4, 62/278, 81, 160, 156, DIG. 17

[56] References Cited

U.S. PATENT DOCUMENTS

| | | | |
|---|---|---|---|
| 3,453,838 | 7/1969 | Decker et al. | 62/196.4 |
| 4,215,555 | 8/1980 | Cann et al. | 62/324 |
| 4,279,129 | 7/1981 | Cann et al. | 62/278 |
| 4,286,435 | 9/1981 | Cann et al. | 62/81 |
| 4,519,214 | 5/1985 | Sano et al. | 62/196.3 |

FOREIGN PATENT DOCUMENTS 0006158 1/1979 Japan .

*Primary Examiner*—Harry B. Tanner

*Attorney, Agent, or Firm*—Antonelli, Terry & Wands

[57] ABSTRACT

An air conditioner includes a compressor, a four-way valve, an indoor heat exchanger, an expansion valve, an outdoor heat exchanger which are connected via pipings to form a heat pump type refrigerant circuit, the four-way valve being switched over to select a heating or cooling mode of operation. This air conditioner is further provided with a first and second branch pipes which extend from an outlet conduit of the compressor, the first branch pipe forming a first bypass pipe connected to an inlet conduit of the compressor. The first and second branch pipes have first and second valves, respectively. The air conditioner is also provided with a microcomputer for selectively opening and closing the second valve in response to the degree of superheating of discharged gaseous refrigerant after the first valve has been opened so that the discharged gaseous refrigerant is supplied to the outdoor heat exchanger to effect a defrosting operation while a heating operation is continued. When the degree of superheating of discharged gaseous refrigerant is low, a part of discharged gas is supplied to the inlet conduit so as to regulate the degree of superheating.

7 Claims, 3 Drawing Sheets

DEFROSTING OF REFRIGERATOR SYSTEM OUT-DOOR HEAT EXCHANGER

BACKGROUND OF THE INVENTION

This invention relates to a defrost operation system and, more particularly, to an air conditioner to which a hot gas bypass defrost system is adopted so as to effect defrost while blowing warm air into a room.

A conventional defrost system for use in an air conditioner, which has a heat pump of a refrigerant circuit formed by successively connecting, via pipings, a compressor, a four-way valve, an indoor heat exchanger, an expansion valve, an outdoor heat exchanger and other components, effects cooling and heating modes of operation by switching over the four-way valve. Since, in this conventional system, defrosting is effected after adapting the refrigerant circuit for the cooling modes of operation by switching over this circuit from a state corresponding to the heating mode of operation to that corresponding to the cooling mode of operation, cooled air is necessarily blown into the room. One possible measure for reducing the flow of cooled air as small as possible is an air heater juxtaposed with the indoor heat exchanger.

Another type of defrost system has been known as a hot gas bypass defrost system. This defrost system operates to melt layers of frost which have sticked to or accumulated on the indoor heat exchanger during heating mode of operation by directly bypassing discharge gas (hot gas) to the outdoor heat exchanger. In this system, the rate of back liquid to the compressor is large because the refrigerant after defrost is directly drawn into the compressor and because this system lacks an evaporator for causing the refrigerant to evaporate after defrost.

A type of countermeasure to this problem was proposed in U.S. Pat. Nos. 4,279,129, 4,215,555 and 4,286,435. In a hot gas bypass defrost system in accordance with these patents, hot gas is bypassed to the outdoor heat exchanger and also to an accumulator on the inlet side of the compressor, but no closing valve is disposed in the bypassing pipe of the accumulator, and the hot gas is controlled by the temperature of refrigerant at the inlet thereof. Therefore, there is a possibility of frost accumulated on the outdoor heat exchanger to be melted excessively rapidly. For this reason, there is a problem that a sensor disposed on the inlet pipe of the compressor may be inoperative (constantly at a saturation temperature) or that the defrost time may be increased because it is necessary to reduce the flow rate of bypassed hot gas when the degree of superheating of discharged gas, is enhanced high enough to make the sensor operative.

SUMMARY OF THE INVENTION

It is therefore an object of the present invention to provide an air conditioner having a hot gas bypass defrost system capable of effecting defrost while effecting a heating mode of operation of blowing warm air into the room so as to maintain a suitable level of comfort during a defrosting operation and capable of reducing back liquid to the compressor and maintaining the reliability of the refrigerating cycle.

To this end, the present invention provides an air conditioner having a heat pump type of refrigerant circuit including a compressor, a four-way valve, an indoor heat exchanger, an expansion valve and an outdoor heat exchanger which are connected through conduits, the four-way valve being switched over to select a heating or cooling mode of operation of the air conditioner, wherein the air conditioner comprising:

a first branch pipe extending from an outlet conduit of the compressor, to form a first bypass pipe and being connected to a conduit, through which the expansion valve and the outdoor heat exchanger communicate with each other, a first valve disposed at the first branch pipe to open/close a passage therein;

a second branch pipe extending from said outlet conduit of said compressor, to form a second bypass pipe and being connected to an inlet conduit of the compressor, a second valve disposed at the second branch pipe to open/close a passage therein; and means for selectively opening and closing the second valve in response to a degree of superheating of gaseous refrigerant discharged from the compressor after the first valve has been opened so that the discharged gaseous refrigerant is supplied to said outdoor heat exchanger to effect a defrosting operation while the heating mode of operation is continued, wherein, when the degree of superheating of discharged gaseous refrigerant is low, a part of discharged gaseous refrigerant is supplied to the inlet conduit of the compressor so as to adjust the degree of superheating of discharged gaseous refrigerant.

In the air conditioner thus constructed, warm air can be blown out even during the defrosting operation since it effects defrost while maintaining the heating mode of operation, thereby maintaining a suitable level of comfort. The amount of hot gas i.e. heated gaseous refrigerant, bypassed from the outlet of the compressor to the outdoor heat exchanger is set to be small compared with the conventional hot gas bypass defrost system. As a result, the degree of condensation of hot gas in the outdoor heat exchanger is reduced, thereby reducing back liquid or the amount of the liquidified refrigerant returned to the inlet of the compressor. At this time, the pressure in the heat exchanger may be low and accumulated frost may not be completely removed. However, as outlet can be communicated by opening the passage through the second bypass pipe to the inlet of the compressor in the air conditioner of the present invention, the pressure in the outdoor heat exchanger can be increased to melt the remaining frost, and the proportion of back liquid can be reduced by conducting hot gas to the inlet of the compressor, and therefore the reliability of the compressor can be enhanced.

BRIEF DESCRIPTION OF THE DRAWINGS

The foregoing and other objects, features, and advantages of the present invention will be made clearer from the following more particular description of preferred embodiments referring to the accompanying drawings in which.

DESCRIPTION OF THE PREFERRED EMBODIMENT

Figure 1:
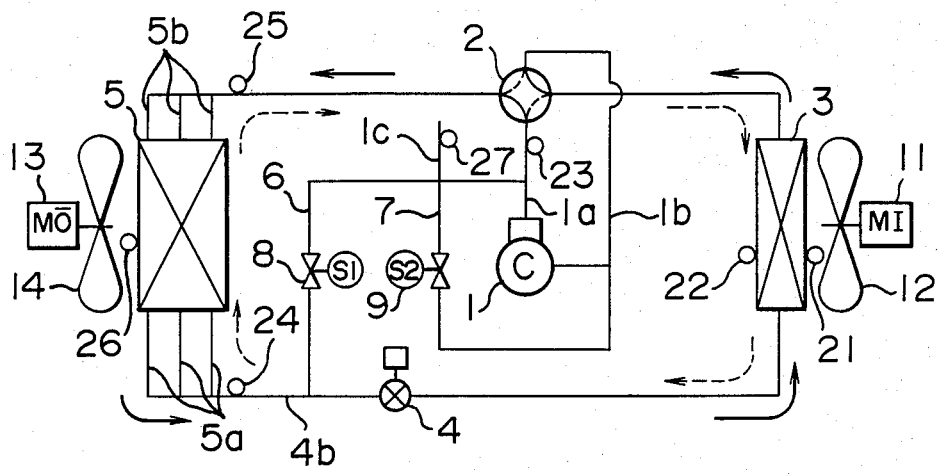
FIG. 1 is a diagram of an air conditioner in accordance with an embodiment of the present invention.

An embodiment of the present invention will be described below with reference to the accompanying drawings. FIG. 1 shows a refrigerant circuit of an air conditioner according to a preferred embodiment of the present invention which is formed by connecting, via pipings, a compressor 1, a four-way valve 2, an indoor heat exchanger 3, electrically-driven expansion valve 4 and the outdoor heat exchanger 5. A fan 12 to which a motor 11 is coupled is mounted on the indoor heat exchanger 3, and a fan 14 to which a motor 13 is coupled is mounted on the outdoor heat exchanger 5. Two bypass pipes 6 and 7 are provided as branches of a discharge pipe la of the compressor 1. The first bypass pipe 6 is connected, via a first electromagnetic valve 8 which allows discharged gas to flow to the outdoor heat exchanger 5, with a conduit **4*b* extending from the electrically-driven expansion valve 4 to the outdoor heat exchanger 5. The second bypass pipe 7 is connected, via a second electromagnetic valve 9 which allows discharged gas to flow to an inlet pipe 1*b*, with the inlet pipe 1*b* of the compressor 1. The resistance of the first bypass pipe 6** to fluid passing therethrough may be selected to be lower than that of the second bypass pipe.

A plurality of branched conduits **5*a* and 5*t* which are connected to the outdoor heat exchanger 5 on the outlet and inlet sides thereof act as distributing pipes which are respectively connected to heat-transfer pipes (not shown) in the heat exchanger 5**.

In FIG. 1, broken-line arrows indicate the direction of flow of refrigerant during a heating mode of operation, and solid-line arrows indicate the direction of flow of refrigerant during a cooling mode of operation.

Figure 2:
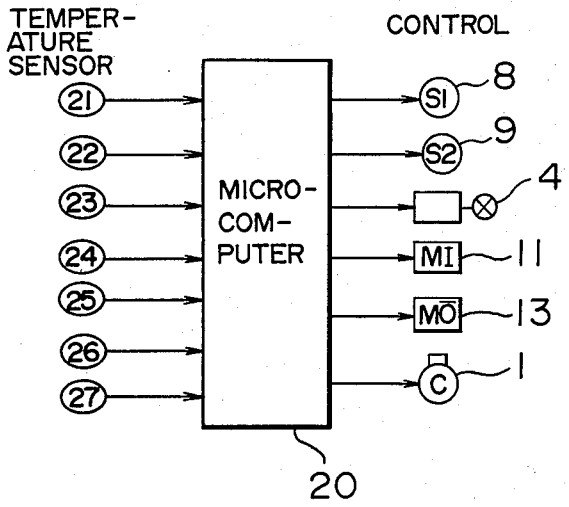
FIG. 2 an illustration of operations of comparing detection signals of temperature sensors with set values by a microcomputor, thereafter delivering signals therefrom for controlling control valves.

The component devices of the air conditioner are provided with temperature sensors 21 to 27. That is, the indoor heat exchanger 3 is provided with a sensor 21 for detecting the intake air temperature and a sensor 22 for detecting the temperature of the air blown through the indoor heat exchanger 3. The discharge pipe **1*a* of the compressor 1 is provided with a sensor 23 for detecting the discharged refrigerant temperature. The outdoor heat exchanger 5 is provided with a sensor 24 for detecting the refrigerant temperature flown thereinto during the heating mode of operation, a sensor 25 for detecting the refrigerant temperature flown therefrom during the heating mode, and a sensor 26 for detecting the temperature of outside air which flows into the outdoor heat exchanger (outside air temperature). A branch pipe 1*c* which extends from the discharge pipe 1*a* is provided with a sensor 27 for detecting the saturation temperature of discharged gas (i.e. the saturation temperature corresponding to the pressure of the discharged gas). As shown in FIG. 2, signals which represent temperatures detected by these sensors 21 to 27 are sent to a microcomputer 20, which controls the opening and closing operation of the bypassing electromagnetic valves 8 and 9, the amount of opening of the electrically-driven expansion valve 4, the electric motors 11 and 13 for the indoor and outdoor blowers, and the rotational speed of the compressor 1**. These control operations will be described later in detail.

Next, the functions of the above-described heat pump system of refrigerant circuit upon heating and cooling modes of operations are described.

At the time of a cooling mode of operation, the four-way valve 2 is switched over as indicated by the solid line so that the refrigerant flows from and returns to the compressor 1 via the four-way valve 2, the outdoor heat exchanger 5, the electrically-driven expansion valve 4, the indoor heat exchanger 3 and the four-way valve 2, as indicated by the solid-line arrows. The outdoor heat exchanger 5 acts as a condenser and the indoor heat exchanger 3 acts as an evaporator for cooling the circulated air in the indoor heat exchanger 3, thereby cooling the room.

Next, the functions upon the heating mode of operation will be described below. The four-way valve 2 is switched over as indicated by the broken line so that the refrigerant flows from and returns to the compressor 1 via the four-way valve 2, the indoor heat exchanger 3, the electrically-driven expansion valve 4, the outdoor heat exchanger 5 and the four-way valve 2, as indicated by the broken-line arrows. Thus the indoor heat exchanger 3 acts as a condenser to transfer heat to the circulated air and warm up this air, thereby raising the temperature in the room while the refrigerant itself is cooled and condensed by this heat exchange at the indoor heat exchanger into a high-pressure liquid refrigerant which flows into the expansion valve 4. The pressure of the refrigerant is lowered thereby, and a low-pressure liquid refrigerant thus obtained is introduced into the outdoor heat exchanger 5 so that the outdoor heat exchanger 5 acts as an evaporator. The liquid refrigerant is evaporated by the heat of the outside air which passes through the heat exchanger 5, and becomes a low-pressure gaseous refrigerant, which returns to the compressor via the four-way valve 4. During this heating mode operation, the first electromagnetic valve 8 and the second electromagnetic valve 9 are not energized and are thus kept closed.

If the heating mode of operation is continued under the condition of the low outdoor temperature and high outdoor humidity, frost accumulates on the surface of the outdoor heat exchanger 5. If the accumulation of frost proceeds further, the flow rate of the outdoor air passed through the outdoor heat exchanger 5 is reduced, resulting in further accumulation of the frost and a reduction in the heating ability of the system and, hence, a reduction in the indoor temperature, thereby lowering the level of comfort. Thus, it is required to carry out a defrosting mode of operation at a suitable time in order to melt the accumulated frost. The procedure of this defrosting operation will be described below with reference to FIG. 3.

When frost has accumulated in the outdoor heat exchanger 5, the heat exchange efficiency or performance thereof is reduced, so that the degree of superheating of the refrigerant at the outlet of the outdoor heat exchanger 5 (which serves as an evaporator) is lowered. To cope with this, the amount or degree of opening of the expansion valve 4 is lowered to reduce the flow rate of the refrigerant therethrough and maintain a desired degree of superheating. As the flow rate of the refrigerant is reduced, the pressure at the inlet of the outdoor heat exchanger 5 and, hence, the temperature Tr of the refrigerant at the inlet of the outdoor heat exchanger 5

(the temperature detected by the sensor 24) are lowered.

Figure 4:
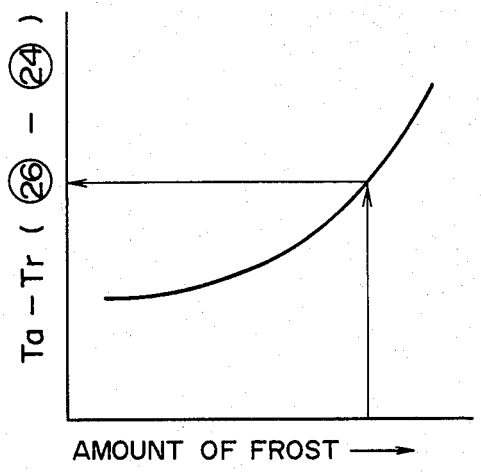
FIG. 4 is a graph showing the relationship between the accumulated amount of frost and the difference between the temperatures of outside air Ta and the temperature of refrigerant at an inlet of an outdoor heat exchanger Tr.

The temperature of refrigerant at the inlet of the outdoor heat exchanger 5 is also changed depending on the temperature Ta of air which flows through the heat exchanger 5 (outdoor air temperature). When the outdoor temperature is changed, the pressure and temperature in the outdoor heat exchanger 5 are changed, which results in the change in the temperature detected by the sensor 24. Therefore, the amount of accumulated frost changes depending on the difference (Ta-Tr) between the outside temperature Ta of air flowing through the outdoor heat exchanger 5 (the temperature detected by the sensor 26) and the temperature Tr of refrigerant at the inlet of the outdoor heat exchanger 5 (the temperature detected by the sensor 24), as shown in FIG. 4, in which the abscissa represents the amount of frost accumulated on the outdoor heat exchanger 5 and the ordinate represents the difference between the outdoor air temperature Ta flowing through the outdoor heat exchanger 5 and the temperature Tr of refrigerant at the inlet of the outdoor heat exchanger 5. As shown in FIG. 4, the amount of frost increases when the temperature difference is larger, and the former is reduced when the latter is smaller. When the temperature Ta of the outdoor air is low and the humidity thereof is high, the frost is likely to be produced on the surface of the outdoor heat exchanger 5, which results in the reduction of the heat exchange efficiency or ability of the outdoor heat exchanger 5, and, therefore, the pressure in the outdoor heat exchanger 5 is lowered. Such being the case, the difference between the outdoor air temperature and the temperature of the refrigerant at an inlet of the outdoor heat exchanger 5 is increased in accordance with the accumulation of the frost. When the temperature difference reaches a preset level, the defrosting operation may be started.

Figure 3:
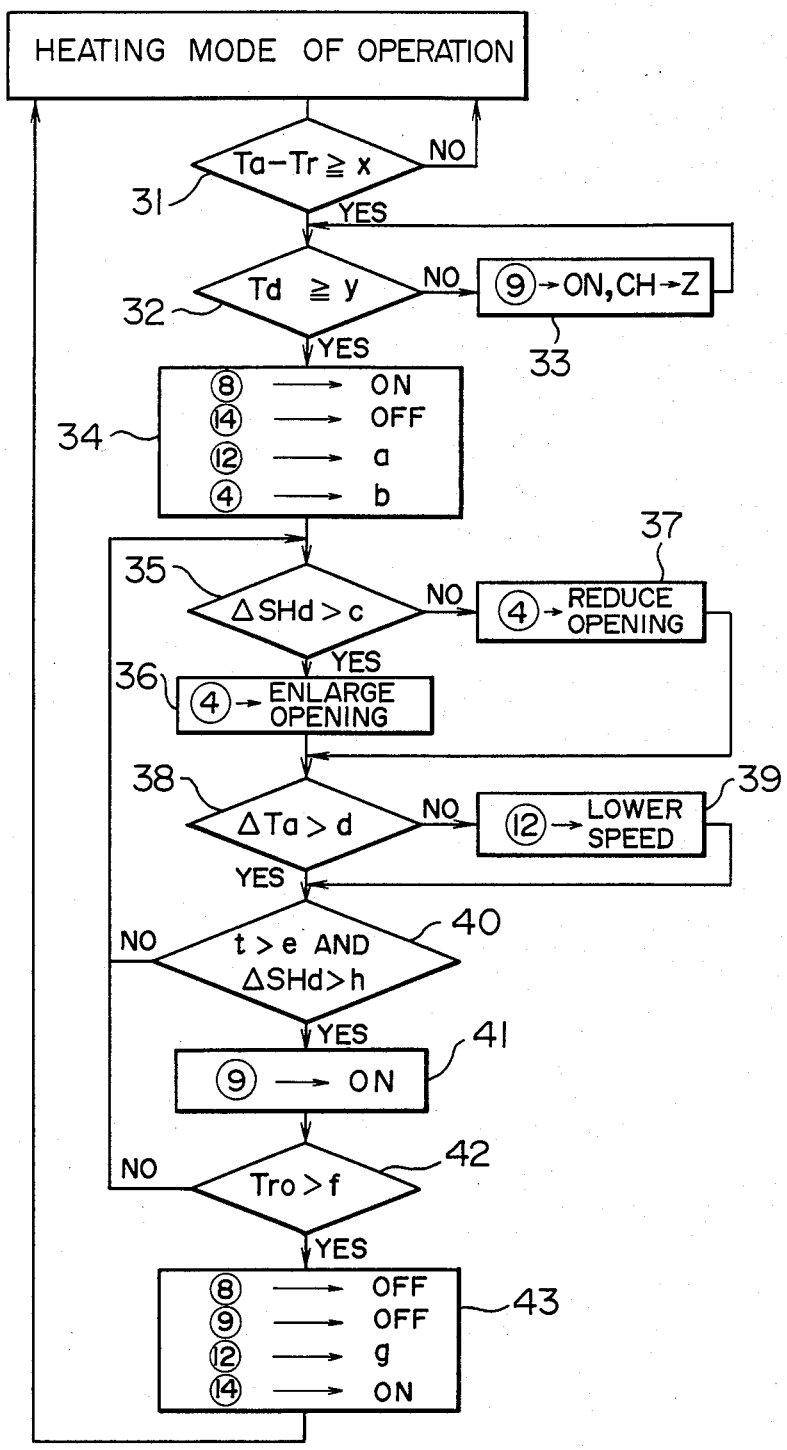
FIG. 3 is a flow chart of a defrosting cycle of operation.

The temperature Ta of air flowing into the outdoor heat exchanger 5 (outside air temperature) and the temperature Tr of refrigerant at the inlet of the outdoor heat exchanger 5 are detected by the sensors 26 and 24, and the detected temperature values are given to the microcomputer 20 which are designed to start controlling a defrosting operation when the difference between the detected temperatures becomes equal to or exceeds a set value x (step 31 in the flow chart of FIG. 3).

After the commencement of the defrosting operation, it is necessary to raise the temperature of the compressor 1 above a set temperature y in order to utilize a part of the heat accumulated or generated by the compressor 1 as a heat source for defrosting. Then, the temperature of the compressor 1 is replaced by the temperature Td of discharged gas from the compressor, which is detected by the sensor 23. If the temperature Td thereby detected is not higher than the set value y, the second electromagnetic valve 9 is energized and thereby opened, thereby bypassing a part of the discharged gas to the inlet side of the compressor 1 via the bypass pipe 7 (steps 32 and 33 in FIG. 3). Simultaneously, the rotational speed CH of the compressor 1 is adjusted to a set value Z (step 33). That is, the degree of superheating of refrigerant drawn into the compressor 1 as well as the input of the compressor are made higher, thereby rapidly raising the temperature Td of gas discharged from the compressor 1 so as to raise the temperature Tr of refrigerant at the inlet of the outdoor heat exchanger 5 to the set temperature. When the refrigerant temperature Tr rises and reaches the set temperature, the second electromagnetic valve 9 is de-energized to close the passage in the pipe 7.

In the defrosting operation, the first electromagnetic valve 8 is energized, and high-temperature and high-pressure refrigerant gas is bypassed to the outdoor heat exchanger 5, thereby effecting defrosting. Simultaneously, the flow rate of the blower 12 for the indoor heat exchanger 3 is adjusted to a set value a, the outdoor blower 14 is stopped, and the amount or degree of opening of the expansion valve 4 is adjusted to a set value b (step 34 in FIG. 3).

In this case, the refrigerating cycle comprises a heating mode of operation cycle in which the opening of the expansion valve is fixed where a bypass of a high-temperature discharged gas to the inlet of the outdoor heat exchanger 5 is furthered added. As a result, the discharging pressure is reduced so that the condensing temperature and, hence, the condensing ability are lowered. However, since the flow rate of air blown by the blower 12 of the indoor heat exchanger 3 is also reduced to the preset level a, the difference ΔTa between the temperatures of air at the inlet and outlet of the indoor heat exchanger 3 (the difference between the temperatures detected by the sensors 21 and 22) can be maintained at a constant level by adjusting the set flow rate of the blower 12 and the amount of opening of the expansion valve 4, maintained the level of comfort in the room.

The expansion valve 4 is operated in such a manner that the amount or degree of opening thereof is increased or enlarged when the degree of superheating ΔSHd of gas discharged from the compressor (ΔSHd =(discharged gas temperature) - (saturation temperature corresponding to the pressure of the discharged gas)) is higher than a set level c and that it is reduced when the degree of super heating lower than the set level c thereby controlling the degree of superheating ΔSHd of gas discharged from the compressor (steps 35, 36 and 37).

In this defrosting cycle, a quantity of liquid refrigerant partially condensed in at indoor heat exchanger 3 and a quantity of liquid refrigerant which is condensed after melting the accumulated frost at the outdoor heat exchanger 5 are drawn into the compressor. If these quantities of liquid are substantial, there is a risk of the compressor being damaged, which reduces the reliability. It is therefore necessary to control the degree of superheating of gas discharged from the compressor 1 which closely relates to the amount or flow rate of back liquid i.e. amount of liquid returned to the compressor 1 after a cycle.

It is also possible to adjust the flow rate of air flown by the blower 12 of the indoor heat exchanger 3 in such a manner that the difference ΔTa (the temperature detected by the sensor 22 - the temperature detected by the sensor 21) between the temperatures of air at the air outlet and inlets of the indoor heat exchanger 3 is adjusted to a set value d (steps 38 and 39).

Figure 5:
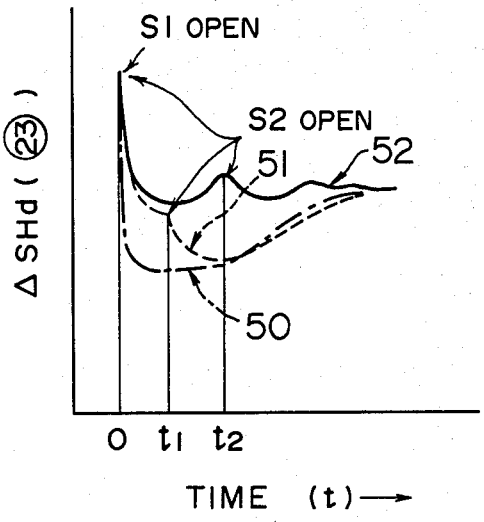
FIG. 5 a graph showing the relationship between the time t in which a second electromagnetic valve is opened during a defrosting cycle of operation and the degree of superheating of discharged gas ΔSHd.

To reduce the defrost time in which the accumulated frost are melted under the control effected in the above-described manner, the second bypass valve 9 is opened when the superheating degree ΔSHd of discharged gas is increased above a set temperature h, if a time t from the commencement of defrosting operation becomes longer than a set time e and if at the same time ΔSHd tends to increase (steps 40 and 41). When the valve 9 is opened, a part of the gas discharged (from the compressor 1 acts to increase the inflow pressure in the inlet piping 1*b* and the condensation pressure in the outdoor heat exchanger 5, thereby raising the temperature of this heat exchanger 5 so that the frost is speedily melted and the defrost time is reduced. However, if the second bypass valve 9 is opened at a time when the degree of superheating ΔSHd is lowered, ΔSHd is further lowered and a larger quantity of liquid refrigerant produced in melting the accumulated frost is returned to the compressor 1. Therefore, the increased amount of liquid refrigerant is not entirely evaporated by the heat accumulated in the compressor 1, thereby causing liquid compression. This results in reduction in the reliability, as described above. If the second bypass valve 9 is opened simultaneously with the first bypass valve 8, the temperature of the discharged gas is abruptly lowered so that a large quantity of liquid refrigerant is returned to the compressor 1 in a similar manner as described above, resulting in reduction in the reliability of the system. FIG. 5 shows the relationship between the change in the degree of superheating ΔSHd and the time in which the second valve 9 is opened.

In FIG. 5, the ordinate represents the degree of superheating of the discharged gaseous refrigerant ΔSHd, and the abscissa represents the time t. When the first and second electromagnetic valves 8 and 9 are opened at the same point of time t=0, the degree of superheating ASHd is abruptly lowered, as indicated by the chain line 50, so that the time required for raising the degree of superheating ΔSHd becomes long. If the second electromagnetic valve 9 is opened after a time $t_1$ has passed from the moment (t=0) at which the first electromagnetic valve 8 is opened, the degree of superheating ΔSHd of discharged liquid refrigerant changes in a course of time, as indicated by the broken line 51. If the second electromagnetic valve 9 is opened when ΔSHd is recovered to h at the time $t_2$ after the first electromagnetic valve 8 has been opened, the degree of superheating ΔSHd of discharged liquid refrigerant changes, as indicated by the solid line 52. That is, if the second electromagnetic valve 9 is opened at the time $t_2$ after the first electromagnetic valve 8 has been opened, the reduction in the degree of superheating ΔSHd of discharged liquid refrigerant is not significant.

When the frost is melted, the temperature Tro of liquid refrigerant at the outlet of the outdoor heat exchanger 5 (the temperature detected by the sensor 25) begins to rise. When Tro becomes equal to a set value f, the bypass valves 8 and 9 are closed, the indoor blower 12 returns to a normal operation q, and the outdoor blower 14 again starts to operate, thus returning the system to the normal heating mode of operation (steps 42 and 43).

According to the present invention, the flow rate of hot gaseous refrigerant flowing through the defrosting bypass valve is set to be lower than that in the case of the conventional hot gas defrost system, while an inlet-side bypass pipe is provided in order to compensate the lower flow rate, whereby hot gas is bypassed to the inlet side so as to raise the pressure at the inlet side after defrosting in the manner of hot gas defrost. By the effect of raising the inlet-side pressure in the above-described manner, the pressure in the outdoor heat exchanger 3 and the temperature of refrigerant flowing into the heat exchanger 3 are raised, thereby completely melting the frost in a twostep manner while controlling the degree of superheating of discharged gas by the expansion valve.

According to the present invention, as described above, the heating mode of operation is continued and the heated or warmed air is blown from the indoor heat exchanger while the defrosting operation is being effected, so that a suitable level of comport can be maintained.

In addition, in the system in accordance with the present invention, the degree of superheating of discharged refrigerant gas is controlled during the defrosting operation, so that the amount of back liquid to the compressor is small compared with the conventional hot gas bypass defrost system, thereby improving the reliability of the apparatus.

What is claimed is:

1. An air conditioner having a heat pump type of refrigerant circuit including a compressor, a four-way valve, an indoor heat exchanger, an expansion valve and an outdoor heat exchanger which are connected through conduits, the four-way valve being switched over to select heating or cooling mode of operation of the air conditioner, wherein the air conditioner comprises:

a first branch pipe extending from an outlet conduit of the compressor to form a first bypass pipe, and being connected to a conduit through which the expansion valve and the outdoor heat exchanger communicate with each other;

a first valve disposed at the first branch pipe to open/close a passage therein;

a second branch pipe extending from said outlet conduit of said compressor to form a second bypass pipe, and being connected to an inlet conduit of the compressor;

a second valve disposed at the second branch pipe to open/close a passage therein; and means for selectively opening and closing the second valve, said selectively opening and closing means being adapted to open the second valve in response to a high degree of superheating of gaseous refrigerant discharged from the compressor after the first valve has been opened so that the discharged gaseous refrigerant is supplied to said outdoor heat exchanger to effect a defrosting operation while the heating mode of operation is continued.

2. An air conditioner according to claim 1, wherein said selectively opening and closing means is adapted to control the second valve of the second bypass pipe such that the second valve is closed for a suitable time after the first valve of the first bypass pipe for defrosting has been opened, and that the second valve is opened after the degree of superheating of discharged gas has been raised higher than a set value.

3. An air conditioner according to claim 1, wherein the second valve is forcibly opened after a set time has passed from a moment at which said first valve is opened.

4. An air conditioner according to claim 1, wherein a resistance of the first bypass pipe to fluid passing therethrough is lower than that of the second bypass pipe.

5. An air conditioner according to claim 1, wherein the means for selectively opening and closing the second valve for supplying the discharged gaseous refrigerant to the inlet conduit opens the second valve when judging that period of time for the defrosting operation exceeds a set period for defrosting and that the degree of superheating of gaseous refrigerant discharged from the compressor is higher than a set value, and wherein the opening/closing means further comprises a sensor for detecting the temperature of refrigerant flowing out of the outdoor heat exchanger, compares the temperature of refrigerant detected by the sensor with a set value, and delivers a signal for closing the second valve when the detected temperature is higher than the set value.

6. An air conditioner according to claim 1, wherein the means for selectively opening and closing the second valve for supplying discharged gaseous refrigerant to the inlet conduit further compresses a sensor for detecting a temperature of gaseous refrigerant discharged from the compressor, compares the temperature of the discharged gaseous refrigerant detected by the sensor with a set value before the defrosting operation delivers a signal for opening the second valve when the temperature of the discharged refrigerant is lower than the set value, and delivers a signal for closing the second valve when the temperature of the discharged refrigerant reaches the set value.

7. An air conditioner according to claim 1, wherein the expansion valve is provided with means for maintaining a set amount of valve opening during the defrosting operation, and means for comparing the degree of superheating of refrigerant discharged from the compressor with a set value and controlling to reduce the amount of opening of the expansion valve when the degree of superheating is lower than the set value and increase the amount of opening of the expansion valve when the degree of superheating is higher than the set value.

* * * * *